US007560671B2

(12) United States Patent
Wheeler et al.

(10) Patent No.: US 7,560,671 B2
(45) Date of Patent: Jul. 14, 2009

(54) TEXTILE LAMINATE STRUCTURES INCLUDING CONDUCTIVE ELEMENTS AND METHOD FOR MAKING SUCH STRUCTURES

(75) Inventors: Brian Wheeler, Landenberg, PA (US); Joseph Gormley, Ambler, PA (US); Thomas A. Micka, West Grove, PA (US)

(73) Assignee: Textronics, Inc., Wilmington, DE (US)

( * ) Notice: Subject to any disclaimer, the term of this patent is extended or adjusted under 35 U.S.C. 154(b) by 352 days.

(21) Appl. No.: 11/535,218

(22) Filed: Sep. 26, 2006

(65) Prior Publication Data

US 2008/0083743 A1 Apr. 10, 2008

(51) Int. Cl.
*H05B 3/02* (2006.01)
*H05B 1/00* (2006.01)

(52) U.S. Cl. ..... 219/538; 219/211; 219/212; 219/217; 219/528; 219/529; 219/544; 219/545; 219/549

(58) Field of Classification Search ..... 219/211–212, 219/217, 528–529, 538, 544–545, 549
See application file for complete search history.

(56) References Cited

U.S. PATENT DOCUMENTS

| | | | | |
|---|---|---|---|---|
| 5,371,657 | A * | 12/1994 | Wiscombe | 362/103 |
| 5,824,996 | A * | 10/1998 | Kochman et al. | 219/529 |
| 6,315,009 | B1 | 11/2001 | Jayaraman et al. | |
| 6,341,504 | B1 | 1/2002 | Istook | |
| 6,687,523 | B1 | 2/2004 | Jayaramen et al. | |
| 6,753,514 | B2 | 6/2004 | Harashima et al. | |
| 2001/0019050 | A1 | 9/2001 | Rock et al. | |
| 2002/0086204 | A1 | 7/2002 | Rock et al. | |
| 2005/0061802 | A1 | 3/2005 | Rock | |

FOREIGN PATENT DOCUMENTS

| | | |
|---|---|---|
| DE | 4239068 | 5/1994 |
| DE | 10020651 | 11/2000 |
| DE | 10342285 | 2/2005 |
| GB | 559322 | 2/1944 |
| GB | 2170680 | 8/1986 |
| GB | 2261290 | 5/1993 |
| WO | WO-9964657 | 12/1999 |
| WO | WO-0020202 | 4/2000 |
| WO | WO-0245946 | 6/2002 |
| WO | WO-03/087451 A2 | 10/2003 |
| WO | WO-2005/123378 A1 | 12/2005 |

* cited by examiner

*Primary Examiner*—Shawntina Fuqua
(74) *Attorney, Agent, or Firm*—Connolly Bove Lodge & Hutz LLP

(57) ABSTRACT

The invention provides a laminate construction for heating or warming with one or more electrically conductive patterns of conductive ink or paste formed on a first confronting surface of an insulating sheet, where each pattern is connected by one or more conductive elements (bus wires), and where each pattern and the conductive elements are between the confronting surfaces of insulating sheets. The laminate may include one or more stretch and recovery elements to cause the laminate to be more adaptable for securing about any three dimensional body. The laminate with heating elements therein may be incorporated into garments or other wearables or into warming textile structures (pads and blankets).

15 Claims, 12 Drawing Sheets

TEXTILE LAMINATE STRUCTURES INCLUDING CONDUCTIVE ELEMENTS AND METHOD FOR MAKING SUCH STRUCTURES

FIELD OF THE INVENTION

The present invention relates to flexible textile laminate structures having an electrically conductive coating applied to a member of the laminate structure to form an electrical circuit. The flexible textile laminate structures have the ability to provide heat or provide warmth by resistive heat dissipation when the electrically conductive coating portion of the laminate is connected to an external electrical source. These laminate structures may be adapted for securing about a three dimensional objects, and optionally may be provided with stretch and recovery properties. Included is a method for making the flexible textile laminate structures.

BACKGROUND OF THE INVENTION

Fabrics having an ability to provide heat or warmth have been disclosed. For example, U.S. Pat. No. 6,753,514 B2 to Harashima, discloses a sheet member that has a heater wire attached. A cylindrical portion containing the heater wire is sewn to a surface of a sheet-like base cloth in a meandering shape. The heater wire contained in the sewn on member generates heat upon application of electrical power.

PCT publication WO 2003/087451 A2 to Sharma ("Sharma") discloses a tubular knit fabric system comprising an electrically insulating yarn, a stretch yarn, and a "functional" yarn knitted together to form a tubular knit fabric. In Sharma, the functional yarn is electrically conductive, having a resistance of 0.01 ohm/meter to 5000 ohm/meter. The functional yarn is embedded within the tubular knit in a continuous spiral that extends the length of a sleeve formed from the tubular knit. Body portions, such as limbs, are surrounded by a portion of the tubular fabric to measure physiological signs. In addition, these tubular knit fabrics disclosed by Sharma are adaptable for use in a narrow elastic band configuration in which the functional yarns serve as parallel conductors for electrical signals. A disadvantage of Sharma's narrow elastic band structures is that the functional yarns or wires must be knitted simultaneously into the structure with all other components. PCT publication WO 2005123378 A1, assigned to Textronics, Inc., provides a laundry-durable laminate composite fabric and a method for forming such fabric. At least one element that provides heat or warmth (heating element), such as a wire or a conductive or "functional" fiber or yarn, is secured within the laminate composite. The laminate composite fabric with heating element(s) is incorporated into garments or warming textile structures (pads and blankets). The Textronics laminate composite fabric may include one or more stretch and recovery elements to cause the laminate to be more adaptable for securing about any three dimensional body.

Electrical conductors or resistors in the form of wires generally cause difficulties in conventional fabric forming processes (e.g. weaving, knitting, seamless knitting). For example, wires and small cables often match poorly with typical textile fibers because of their fragility, elastic modulus, extensibility, and tensile strength. Generally, wires and wire carrying structures are incorporated in the fabric or garment by sewing means, although Sharma proposes knitting wires directly into the textile construction. Wires and small cables are particularly disadvantageous where elastic recovery and flexibility from the structure or garment is desired and/or where the ability to wash or launder a garment is desired. Thus, flexible textile structures are needed that can overcome one or more deficiencies of the prior art. An ability to provide a robust and flexible fabric structure with integral heating elements would be highly desirable.

SUMMARY OF THE INVENTION

The invention relates to in a first aspect an electrically conductive laminate for heating or warming that has first and second substantially electrically insulating material sheets adhered to one another on confronting surfaces, with first and second electrical conductor means provided between the confronting surfaces of the sheets. One or more patterns are provided on a portion of the confronting surface of the first sheet, wherein each pattern is selected to provide electrical conductivity and wherein a portion of said pattern electrically contacts the conductor means at regions of intersection. Where a plurality of patterns has been provided on the first sheet, said patterns may be arranged serially and coextensively with the electrical conductor means so as to have a plurality of regions of intersection between the patterns and the electrical conductor means. In this case, at least one region of intersection further comprises a means to selectively interrupt the electrical contact of at least one of the electrical conductor means, such as a void or punched hole extending along a substantially vertically aligned axis to the plane of the laminate.

In this first aspect of the invention, the pattern(s) may be formed with electrically conductive ink applied onto the confronting surface, and the electrical conductor means may be one or more bus wires. The substantially electrically insulating materials may be nonwoven fabric, woven fabric, knit fabric, paper, or polymer film.

An alternate embodiment of the laminate may incorporate at least one stretch and recovery element coextending with the electrical conductor means. Such stretch and recovery element may be a fiber or strand or multiple fibers or strands of elastic material, such as spandex.

The laminate of the invention may be incorporated into a garment or other wearable or into a blanket or heating pad to provide heating and warming due to electrical resistance.

Another aspect of the invention is a method for making an electrically conductive laminate. In such a method, one or more patterns are formed image-wise on a surface of a first sheet of a substantially electrically insulating material using an electrically conductive ink or paste. At least one length of an electrically conductive wire is co-extended and aligned to intersect at least a portion of the pattern(s) to form an electrically conductive region of intersection between wire and pattern. A second sheet of a substantially electrically insulating material is secured to the first sheet by adhesive means between the confronting surfaces of such sheets. Together, the pattern(s) and the conductive wire and the sheets form the laminate when the confronting surfaces are secured and the pattern(s) and conductive wire are within said laminate.

In one embodiment, the method further includes forming at least one void through the laminate, wherein said void extends along a substantially vertically aligned axis to the plane of the laminate. Such void may be formed by hole punching.

The pattern(s) may be repeating patterns with discrete pattern components separated by discontinuities. In such case, multiple heating and warming laminate structures may be formed by separating at least one discrete pattern component from the remaining pattern components to form first and second laminates from the laminate.

BRIEF DESCRIPTION OF THE DRAWINGS

The present invention will be described in the following detailed description with reference to the following drawings.

DETAILED DESCRIPTION OF THE INVENTION

The heating and warming laminates disclosed herein include at least two layers, and may be formed to have a substantially flat top and bottom surface. Electrically conductive elements preferably are formed with electrically conductive ink or paste applied onto a surface of a first layer. The electrically conductive elements are then sandwiched between the first layer and a second layer to form the laminate.

Figure 1:
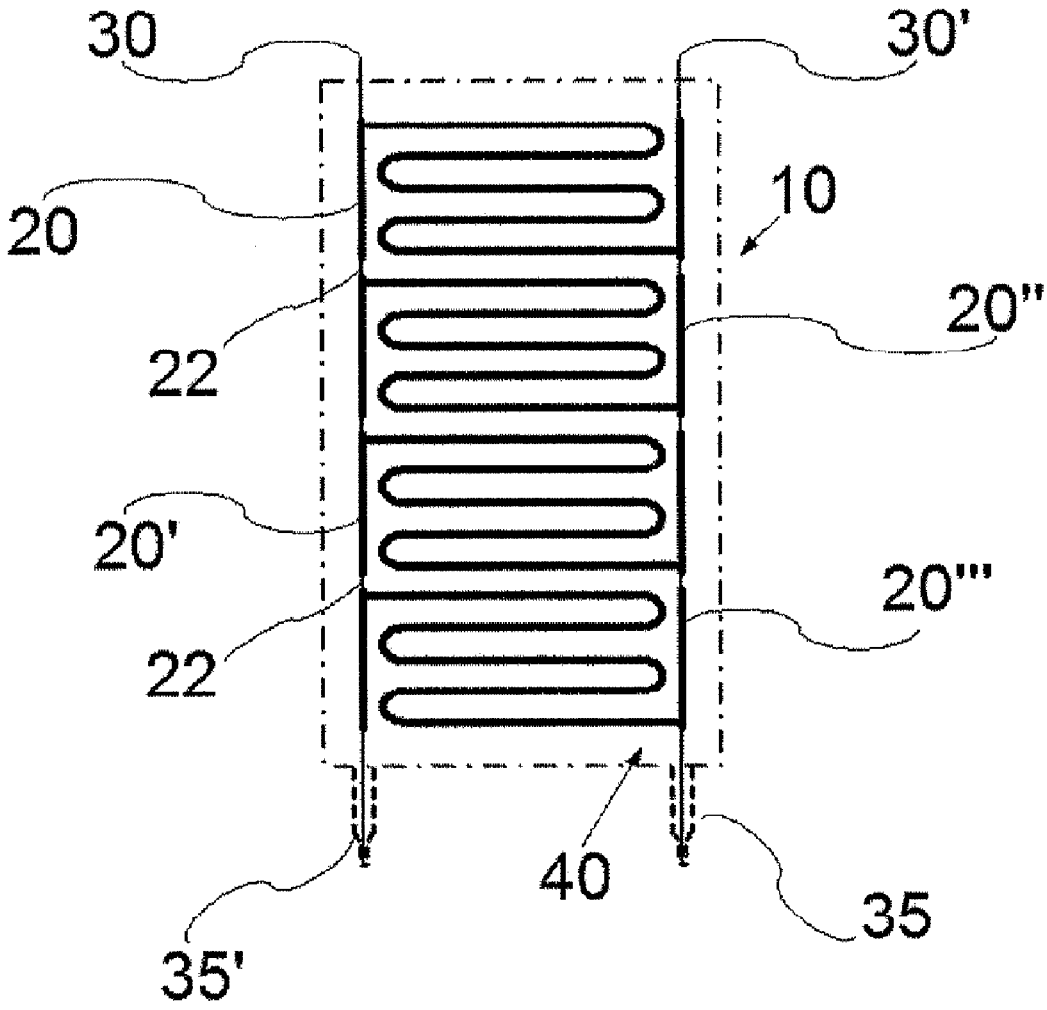
FIG. 1 is a schematic representation in top plan view of an embodiment of a heating or warming laminate of the invention.

Referring first to the embodiment of FIG. 1, the laminate 10 has four serpentine patterned electrically conductive elements 20, 20', 20" and 20'" comprising electrically conductive ink or paste formed on a surface of at least one layer 40. Layer 50 covers or substantially covers the electrically conductive elements 20 when the confronting surfaces of layers 40, 50 are joined together to form the laminate 10. The materials of each layer 40 and 50 are sheet components that are generally not electrically conductive. Such sheet components may comprise nonwoven fabrics, woven textiles, paper or film.

The laminate 10 further comprises electrical conductors 30, 30' (e.g., "bus wires"), which provide electrical contact with the patterned electrical elements 20, 20', 20" and 20'". The electrical conductors 30, 30' (bus wires) are selected from copper wire of circular, flat or another cross selection shape, such as a ribbon conductor, and may be multi-stranded or braided wire as well. A fine-strand braided copper wire with an equivalent of 26 AWG is one example. The electrical conductors have low electrical resistivity, e.g., 0.1 ohm/meter to 100 ohm/meter.

An adhesive composition applied between confronting surfaces of the layers of the laminate 10 bonds the outer layers 40, 50 and electrical conductors 20, 30 together in a sandwich style configuration, with the electrical conductors 20, 30 between the confronting surfaces of the outer layers 40, 50. Each element in the laminate is generally bonded to at least one other element of the laminate. For example, an adhesive may be applied to the confronting surface to which the patterned elements are applied and in turn adhered to the confronting surface of the outer layers. The adhesive may also be applied directly to the conductive bus wire 30 and 30'. The adhesive composition can, for example, constitute from about 5% to 70% of the weight of the composite laminate. Suitable adhesive compositions can, for example, be hot melt adhesives, such as styrene-based block copolymers, including styrene/isoprene and styrene/butadiene block copolymers. Bonding the laminate together by other methods may be possible, such as heat source lamination, laser or ultrasonic welding, where such techniques can be carried out without harming the patterned element 20 of conductive ink or paste.

Electrically conducting adhesives optionally may be used to bond the electrical conductors 30, 30' to the patterned electrically conductive elements 20, 20', 20", 20'" to enhance contact between the conductors and conductive elements.

Figure 1A:
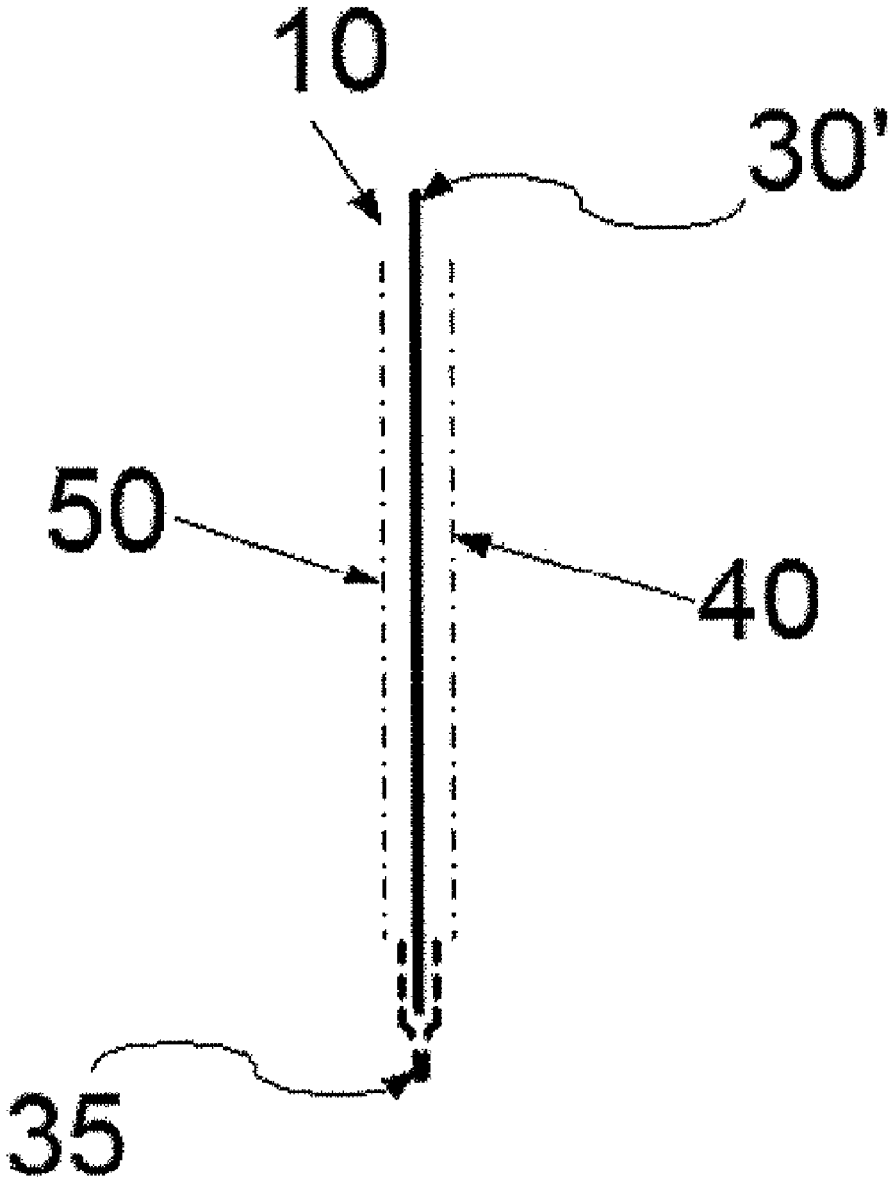
FIG. 1*a* is an exploded view in side elevation of the heating or warming laminate of FIG. 1.

The patterned electrically conductive elements 20, 20', 20" and 20'", represented in FIGS. 1 and 1*a*, may be electrical resistance heating elements that are adaptable to being connected to a source of electrical power. Such electrically conductive elements 20, 20', 20", 20'" generally may be connected via a pair of bus wires 30, 30'. The bus wires 30, 30' may be provided with connectors (e.g., crimp-on connectors, solder connectors) 35 and 35' at their terminal ends. Bus wires 30, 30' are spaced apart in generally parallel relation and contact the patterned electrically conductive elements 20, 20', 20" and 20'" at the outer borders of such elements. With such bus wire configuration, the laminate 10 may be formed with a plurality of patterned electrically conductive elements 20, 20', 20" and 20'" in series, and the length of the laminate with patterned electrically conductive elements may extend to any desired length by adding additional patterned conductive elements in series. Electrically conductive means, such as bus wires, can be incorporated into the laminate without stitching or weaving. Hence, the laminate structure can be formed at speeds up to 300 feet per minute (91.4 m/min). The laminate may be shortened by cutting through the laminate and the bus wires at pattern discontinuities 22 shown in FIG. 1.

The electrical conductor means (e.g., bus wires) are connected to a power source to supply electrical power to the electrical resistance heating elements (e.g., conductive ink pattern). The power source may be an external source of electrical power which may be alternating current (AC), but more typically will be direct current (DC), such as from a battery (not shown). Preferably for certification by Underwriters Laboratories Inc. (UL®), the voltage supplied by the power source to the electrical resistance heating elements of the pattern is lower than 25 volts, e.g., a Class II UL® certified transformer may be used to step down a 110v power supply to 25 volts or under.

The electrically conductive elements 20, 20', 20" and 20'" may be formed from an electrically conductive paste or ink which is patterned (image-wise formed) on an inner or confronting surface of one or both nonconductive sheet component outer layers 40 and 50. A useful means to image-wise form elements 20, 20', 20" and 20'" is screen-printing the pattern onto a surface of a layer (e.g., layer 40 in FIG. 1). Other methods for precise pattern printing, such as inkjet technology, are useful for forming the conductive elements.

Suitable electrically conductive inks include, but are not limited, those inks sold by DuPont iTechnologies, Wilmington, Del. as silver ink 5021 or silver ink 5096, or Xink conductive inks offered by Acheson Electronic Materials, and the like.

Figure 2A:
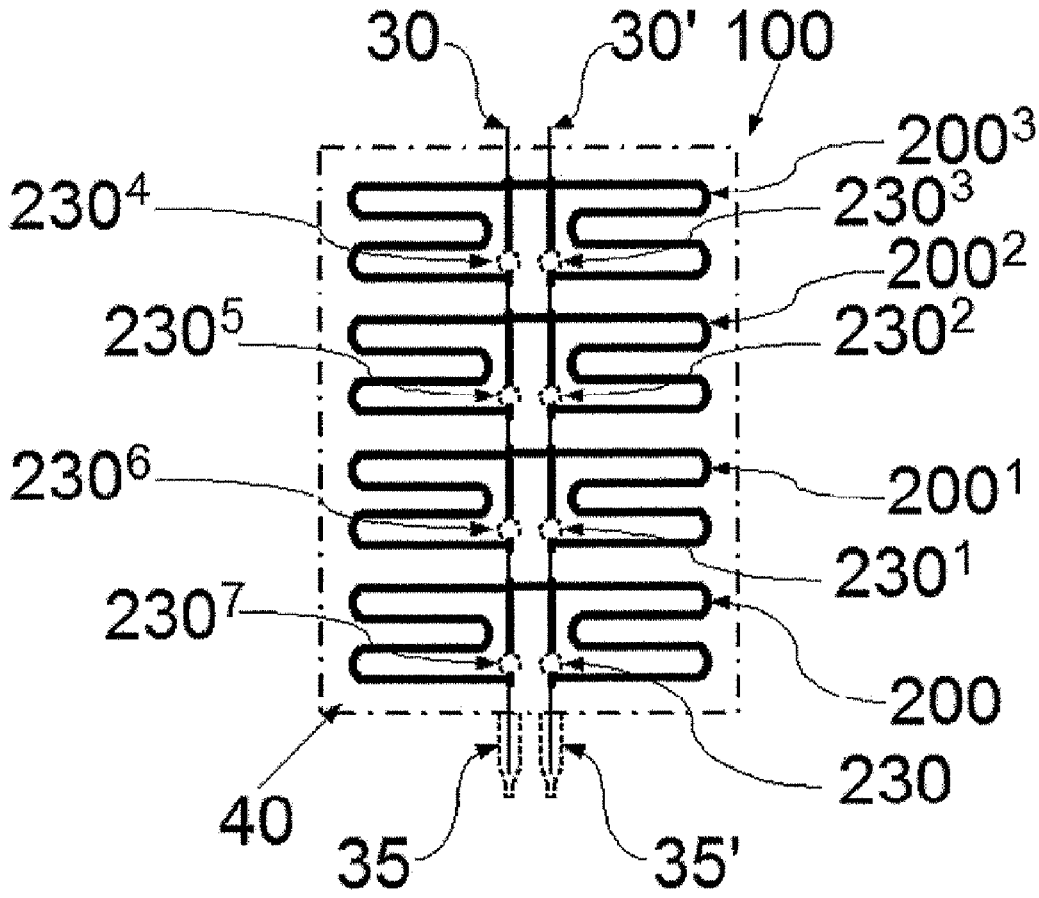
FIGS. 2*a* and 2*b* are schematic representations in top plan view of another embodiment of the laminate of the invention.

Another embodiment of the laminate is represented by 100 in FIG. 2*a*. The laminate 100 has eight electrically conductive elements, 200-200$^7$, formed in a serpentine pattern. As printed, the electrically conductive elements are in pairs (e.g., 200 and 200$^7$ is a first pair, and 200$^1$ and 200$^6$ is a second pair), and separated from an adjacent pair by a discontinuity in the printing pattern. Each electrically conductive element 200 contacts closely spaced bus wires 30 and 30', whereby the pairs of electrically conductive elements are then connected together. Bus wires 30, 30' are spaced apart in generally parallel relation and terminate at associated connectors 35 and 35'. In view of the closer spacing of bus wires 30, 30' in FIG. 2*a*, as compared with the more distant spacing of bus wires in FIG. 1, the associated connectors at the terminal ends 35, 35' in FIG. 2*a* may be connected to one plug to form an electrical circuit. Comparable to the embodiment shown in FIG. 1, the laminate 100 is comprised of nonconductive sheet components 40 and 50, and the electrically conductive elements 200-200$^7$ and bus wires 30, 30' are sandwiched between such sheet components.

Each patterned element 200-200$^7$ of laminate 100 is provided with at least one aperture or through-hole 230 passing entirely through the laminate. The through-holes 230-230$^7$ remove a portion of the conductive ink or paste and can break the bus wires 30, 30' so as to create an electrical discontinuity in the conductive path of the patterned element. Such discontinuity ensures that the patterned elements can together create a circuit path for conducting electricity. Such through holes may be punched or cut in a separate step after the laminate is formed. The laminate 100 shown in FIG. 2*a* as having an indefinite or unspecified length and width. The conductive ink pattern thereon may be repeated multiple times on or within the laminate to form a roll stock. The laminate may then be cut to size and additional apertures or through-holes 232 punched or cut therein to create the desired circuit path (See FIG. 2*b*).

Figure 2B:
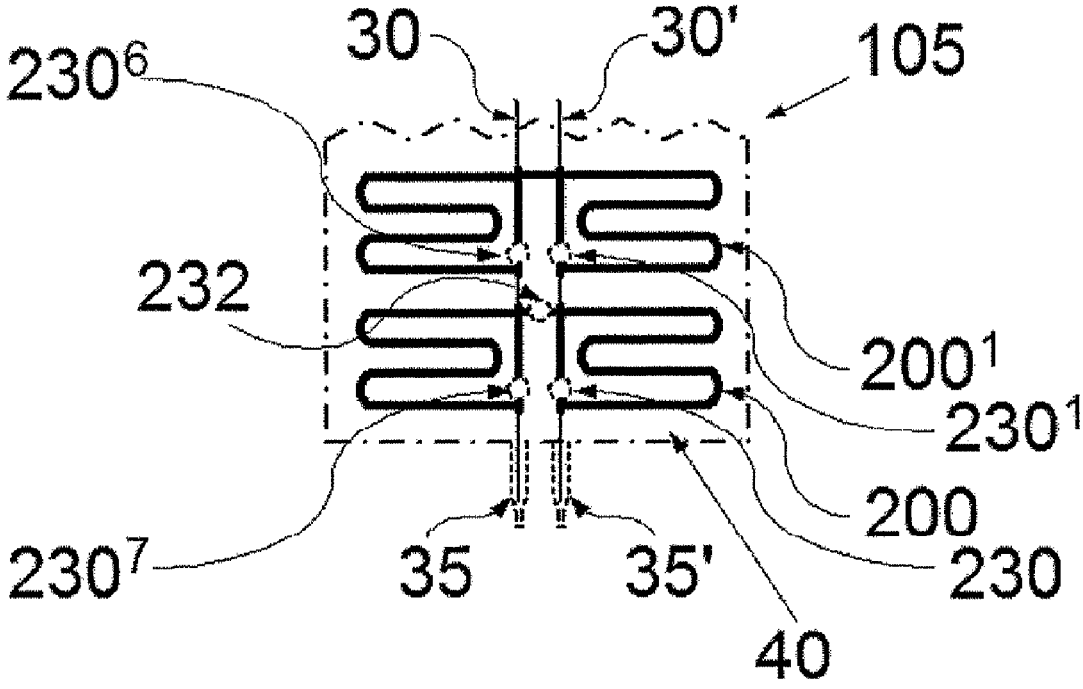
Figure 2C:
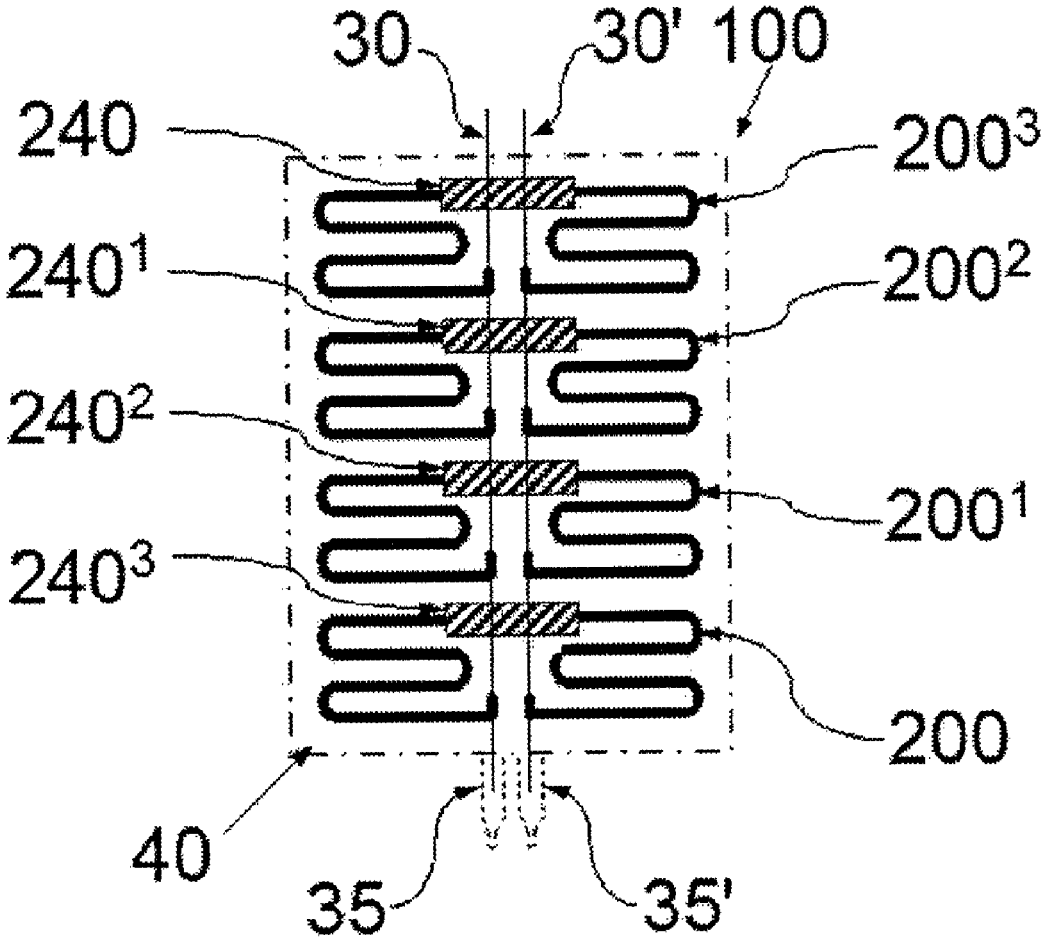
FIG. 2*c* is a schematic representation in top plan view of still another embodiment of the laminate of the invention.

Alternatively, where through holes are not desired, an insulator material 240 may be deposited or applied at discrete locations between the conductive pattern ink and the bus wires, as shown in FIG. 2*c*, to prevent physical (and therefore electrical) contact between bus wires and the conductive elements at such discrete locations. The insulator material may be a patch of nonwoven fabric, woven textile, paper or film. The insulator material may be the same as or different from sheet components forming layers 40. Such discontinuity in conductive path due to the insulator material ensures that the patterned elements together create a circuit path for conducting electricity.

Another embodiment of the laminate is represented by 105 in FIG. 2*b*. The laminate 105 in FIG. 2*b* is a discrete portion separated from laminate 100 in FIG. 2*a* (e.g., by any cutting or slicing means which cuts the laminate 100 and its bus wires 30, 30'). Laminate 105 includes two pairs of patterned elements 200 and 200$^7$ as the first pair and 200$^1$ and 200$^6$ as the second pair, two bus wires 30, 30' and four through-holes 230, 230$^1$, 230$^6$, and 230$^7$ which interrupt the continuity of the patterned elements at two contact points overlying the bus wires 30 and 30'.

Figure 3A:
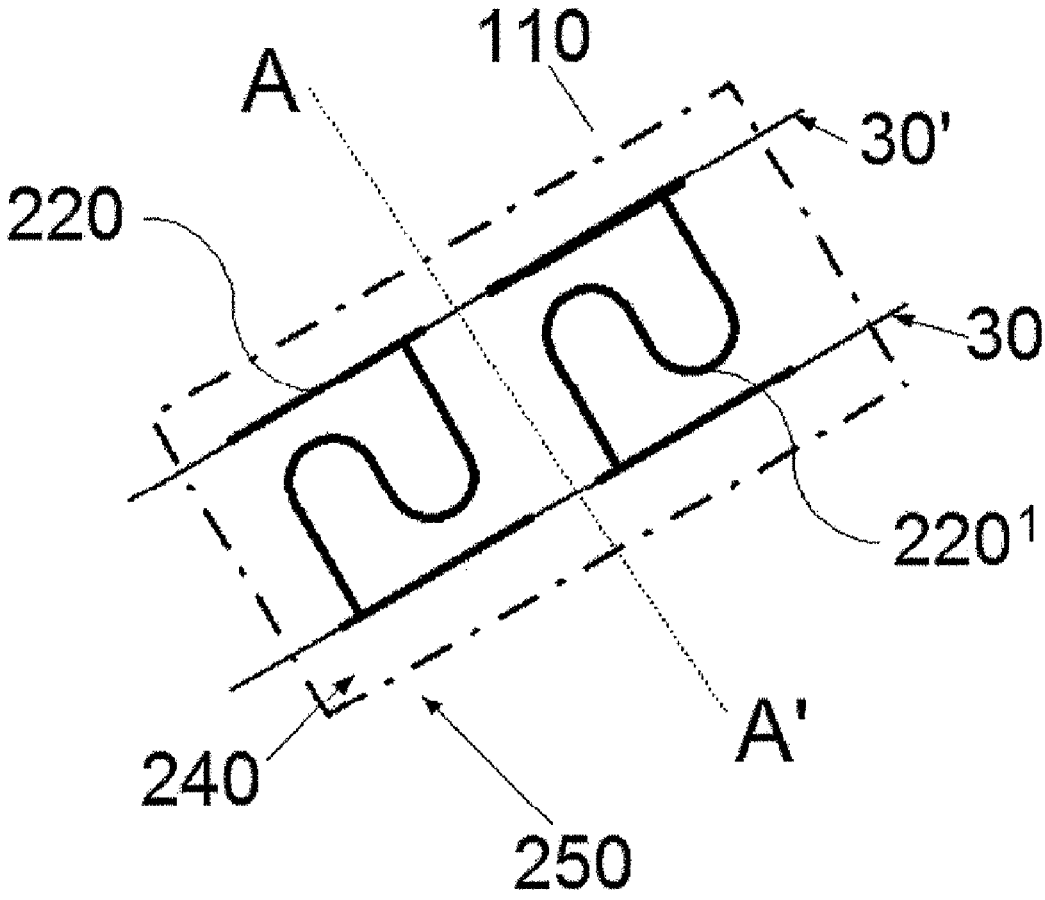
FIGS. 3*a* and 3*b* are schematic representations in top plan view of another embodiment of the laminate of the invention.

In another alternate embodiment of the invention laminate 110 represented in FIG. 3*a* a plurality of patterned elements 220, 220$^1$ is formed on one or both of either confronting surfaces of the sheet materials 240 and 250. Patterned elements 220, 220$^1$ are formed with discontinuities 222, 222' between the patterns, such as at axis A-A' in FIG. 3*a*. Bus wires 30 and 30' contact the patterned elements 220, 220$^1$ and form an electrically conductive pathway through each element, effectively in parallel. The structure in FIG. 3*a* is adaptable to be connected to a source of electrical current via bus wires 30, 30', and the patterned elements function as parallel resistors in the conductive path.

Figure 3B:
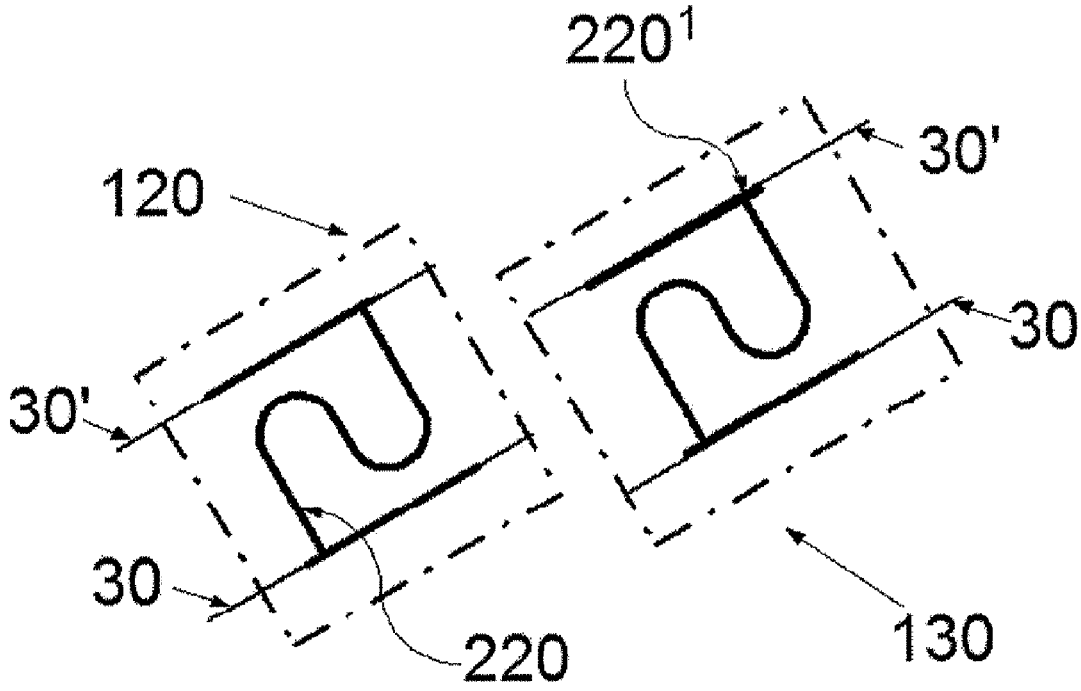

In yet other embodiments of the invention 120, 130 represented in FIG. 3*b*, laminates 120, 130 with two patterned elements 220, 220$^1$ are shown as separated from laminate 110 about an axis A-A' represented in FIG. 3*a*. Each separated laminate 120, 130 may be adapted to function as an independent heating element when used with a suitable source of electrical current, e.g., a battery or power supply connected to bus wires 30, 30'. Laminate 110 (FIG. 3*a*) may be separated into individual laminates 120 and 130 (FIG. 3*b*) by cutting the laminate 110 with any suitable scissors or cutting or shearing device.

A garment, wearable, heating pad or electric blanket may incorporate one or more of the laminates according to the invention. For example, an electric blanket may include a plurality of the laminates 10 as shown in FIG. 1, laminates 100 as shown in FIG. 2*a*, laminates 105 as shown in FIG. 2*b*, laminates 110, 120, 130 as shown in FIGS. 3*a* and 3*b*. Depending upon parameters such as overall power consumption and heating rate required for such a heating blanket, the number of laminates 10, 105, 110, 120, 130 are chosen accordingly.

Figure 5:
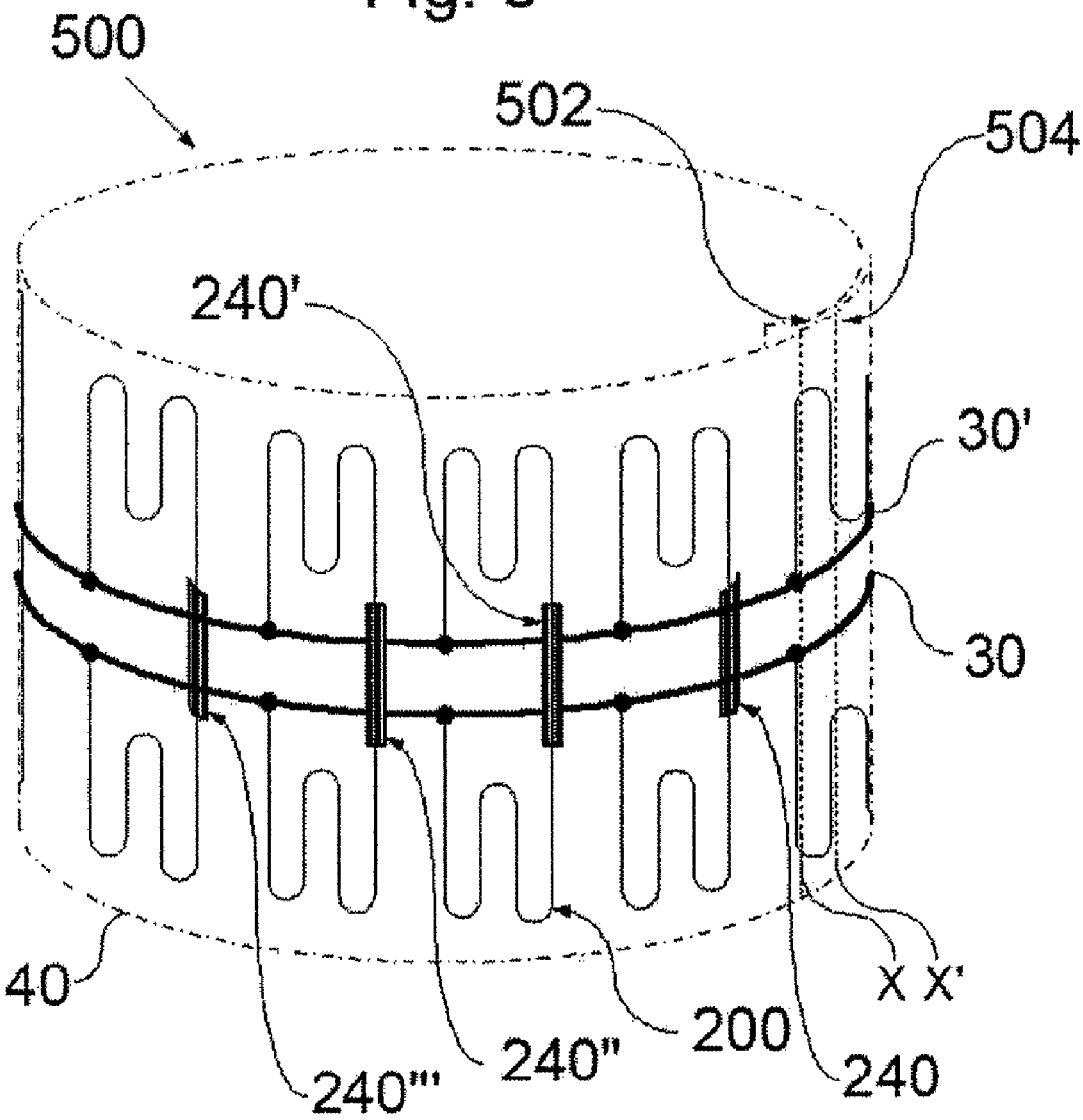
FIG. 5 is a schematic perspective view of a cuff or sleeve to formed with the heating or warming laminate of FIGS. 2*a* and 2*b;*

A garment sleeve or leg or arm cuff 500 may incorporate one or more laminates according to the invention as shown, for example, in FIG. 5. As shown in FIG. 5, a laminate structure such as that in FIG. 2*c* is wrapped to form a sleeve or cuff or band 500 and removably secured with mating hook and loop fastener strips (i.e., Velcro® closure) applied to facing surfaces of a portion of the structure between lines X-X' in FIG. 5. Various hook and loop fasteners and means for engaging such fasteners to a substrate are known to persons skilled in the art and are textile and garment compatible.

Figure 6A:
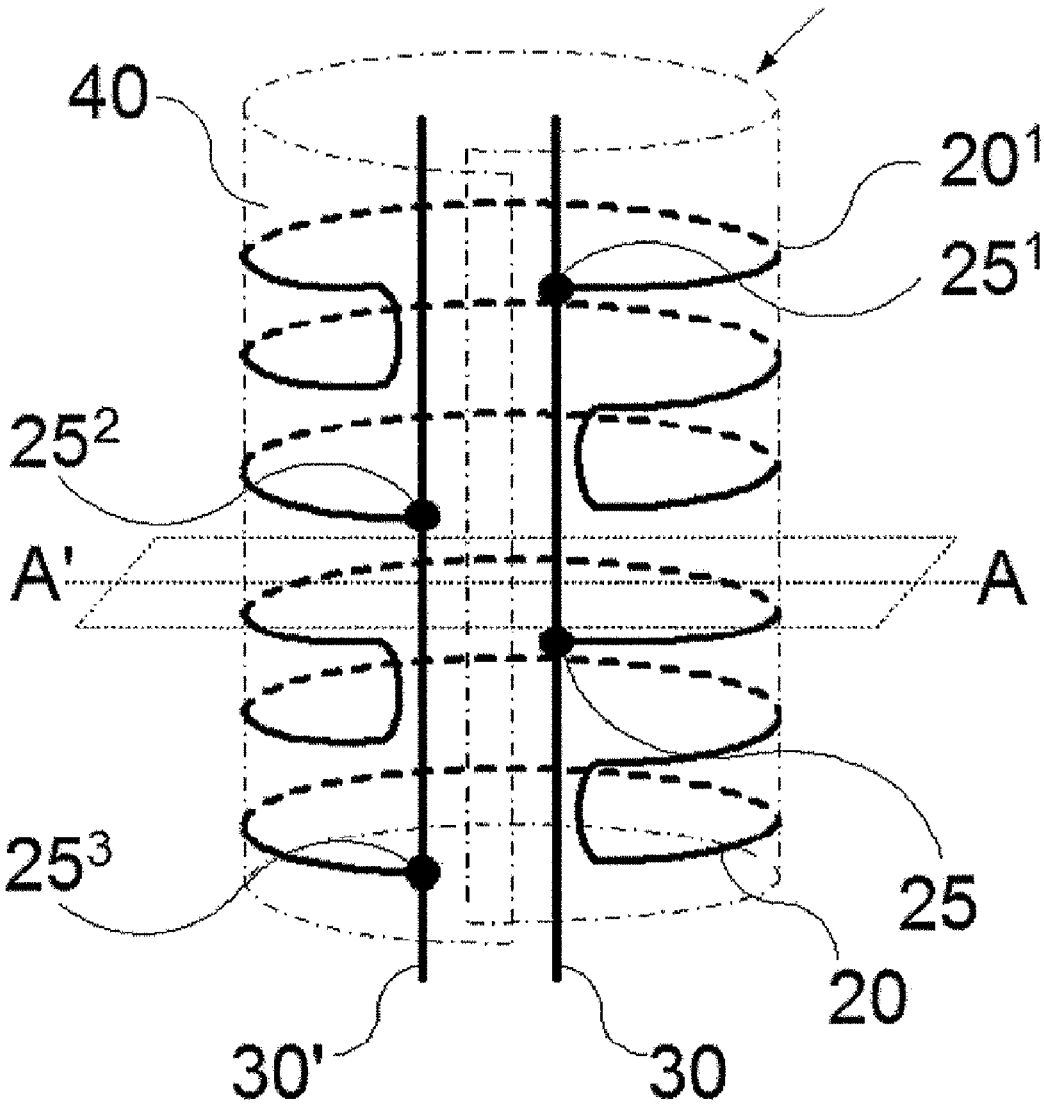
FIGS. 6*a* and 6*b* are schematic perspective views of yet another alternate embodiment of the laminate of the invention.
Figure 6B:
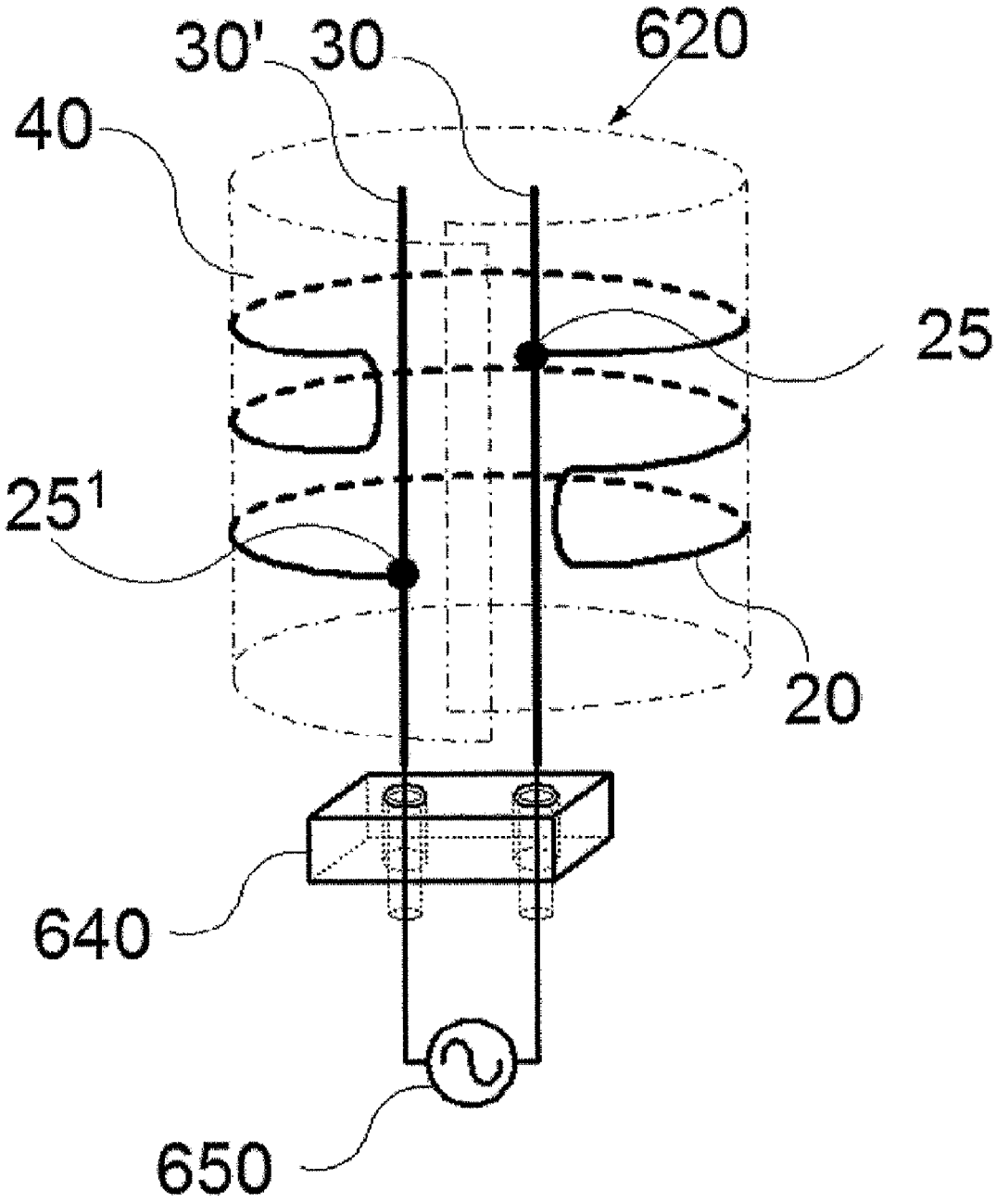

Another embodiment 600 of the invention is shown in FIGS. 6*a* and 6*b*. Such embodiment 600 is derivable from the embodiment 10 shown in FIG. 1*a*. The laminate is comprised of two conductive patterns 20 and 20$^1$ which electrically contact each of the bus wires 30, 30' at points shown as 25, 25$^1$, 25$^2$ and 25$^3$. The laminate 600 otherwise is substantially like that described in FIG. 1*a*.

In this embodiment 600, substantially cylindrical symmetry is achieved by bringing bus wires 30, 30' closely together when overlapping the edges of the laminate surfaces 40. With such symmetry, the laminate structure forms a cuff or sleeve that may be placed on a person's arm or leg or other limb, or may be placed around another substantially cylindrical body. Bringing bus wires 30, 30' closely together better facilitates an electrical connection to an external current supply.

As shown in FIG. 6*b*, the laminate 600 from FIG. 6*a* may be cut into substantially equivalent portions that are able to function independently. For example, cutting the laminate along line A-A' in FIG. 6*a* divides the laminate 600 into two independent, substantially cylindrical units, one of which is represented as 620 in FIG. 6*b*. The laminate unit 620 optionally is provided with an electrical connector 640 and in turn to a source of electric current 650.

Optionally, the laminate structure may further include at least one stretch and recovery element bonded between the outer layers 40, 50. One stretch and recovery element and means for introducing such into a laminate structure is shown in PCT Application WO 2005123378 A1, the disclosure of which is incorporated by reference in its entirely for all useful purposes. A laminate with a substantially puckered appearance results when the stretch and recovery element is in a relaxed or unstretched state.

Figure 4:
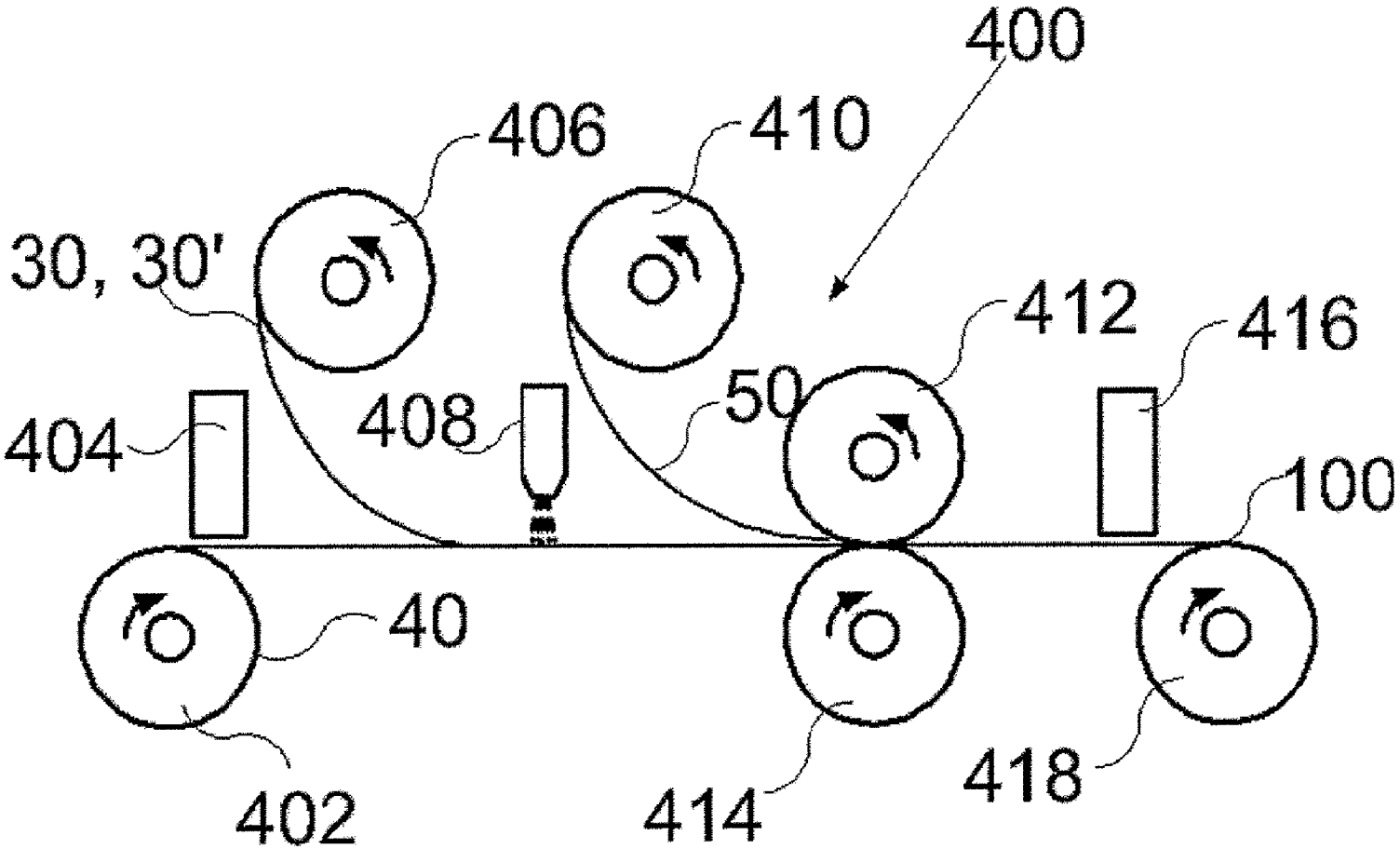
FIG. 4 is a schematic representation of an embodiment of apparatus for carrying out a method for making a heating or warming laminate of the invention.

The invention further relates to a method for preparing a laminate adaptable for use in heating and warming applications. Referring to FIG. 4, a schematic representation of apparatus 400 to form a laminate, such as laminate 100, is shown. A sheet material layer 40 is unwound from a supply roll 402 and a conductive element pattern is printed on a surface of the sheet 40 by screen printing equipment 404 with a conductive ink. Bus wires 30, 30' are then laid over the conductive element pattern. For simplicity of illustration, one bus wire supply roll 406 is shown in FIG. 4, but multiple bus wire supply rolls may be used. A heat activated adhesive is then applied to the dried conductive element pattern surface and the surface of sheet 40 from an applicator 408. The adhesive may be applied in a pattern, such as a dot pattern, a line pattern, a dash pattern, or any other desired adhesive pattern, or may be laid down as a film of a desired thickness. Top sheet material layer 50 is then laid over the bus wires, conductive element pattern and sheet 40. Top sheet 50 is unwound from a supply roll 410. The combined elements are then compressed in the nip between heated rolls 412, 414 to cure the adhesive and form the laminate 100. A punch 416 then forms holes through the laminate at discrete selected locations (see 230 in FIG. 2*a*) to create discontinuities in the conductive pattern, so that a continuous electrical circuit may be formed. The laminate 100 with punch holes is then wound on roller 418 for storage until use. Upon use, a desired length of the laminate 100 is unwound from the roller 418, and the laminate 100 is cut to form a heating and warming laminate. Terminal ends (see 35, 35' in FIG. 2*a*) may be applied to the bus wires of the laminate to enable electrical connection with a plug (not shown).

Stated alternatively, a method for making a laminate according to the invention may include the following steps: (1) providing a length of sheet material having a first surface and a second surface; (2) providing or applying a conductive element onto the first surface; (3) extending and fixing at least a length of bus wire coextensively with the first length of sheet material, such that the extended length the bus wire is secured to the first surface of the length of sheet material along a substantial portion of the fixed length thereof and in contact with the patterned conductive element; (4) providing a second length of sheet material having a first surface, which is the confronting surface, and a second surface; and (5) securing the confronting surface (the first surface) of the second length of sheet material to a confronting surface (the first surface), of the first length of sheet material along a substantial portion of the length thereof to form a laminate with the bus wire sandwiched between confronting surfaces of the sheet materials. Optionally, a third length or additional lengths of sheet material may be provided to the laminate and similarly attached to the second surfaces of the first and second lengths of sheet material. While the method steps have been set forth in a number order above, a different step order may be appropriate in some circumstances and the method according to the invention is not intended to be limited to that set forth herein.

If it is desired to form an alternative laminate structure having stretch and recovery properties, the method further may include (6) extending and fixing at least one length of a stretch and recovery element to at least about 50% of its undeformed recoverable extension limit and securing such extended stretch and recovery element to the first surface of the first length of material, such that the stretch and recovery element is coextensive with the bus wires. Once the first and second lengths of sheet material are bonded together or are bonded to the stretch and recovery element, the extended length of said stretch and recovery element may be substantially relaxed, allowing the laminate to pucker. In one embodiment, the stretch and recovery element may be one or more spandex fibers.

In an embodiment of the present invention the laminate comprises at least first and second portions of substantially electrically insulating materials adhered to one another on confronting surfaces. First and second electrical conductor means and a patterned portion applied to the confronting surface of the first portion of insulating material are provided between confronting surfaces of the insulating materials. The patterned portion is selected to provide electrical conductivity and a portion of the patterned portion electrically contacts the conductor means at regions of intersection. The substantially electrically insulating materials may be sheets of non-woven fabric, woven fabric, woven textile, paper or film, such as polymer. The patterned portion may be formed with conductive ink or paste. The first and second electrical conductor means may be bus wires.

In an embodiment of the present invention the laminate comprises a plurality of patterned portions and the patterned portions are arranged serially and coextensively with a conductor means and define a plurality of regions of intersection. At least one region of intersection comprises a means to selectively interrupt the electrical contact of the at least one conductor means. The selective interruption of the electrical contact with the conductor means comprises at least a void (a hole) extending through the laminate along a substantially vertically aligned axis to the plane of the laminate. Included as an embodiment of the present invention is a method for making the laminate of the present invention comprising providing at least a void extending along a substantially vertically aligned axis to the plane of the laminate. Included as an embodiment of the present invention is a method for making the laminate of the present invention comprising providing a least a void extending along a substantially vertically aligned axis to the plane of the laminate by hole punching.

In an embodiment of the present invention the laminate comprises patterned portions of electrically conductive ink applied onto a confronting surface of at least one of the electrically insulating materials. In an embodiment of the present invention the laminate is adapted to supply heat when connected to a source of electrical power.

In an embodiment of the present invention the laminate comprises a garment or wearable incorporating the laminate. In an embodiment of the present invention the laminate comprises a blanket for heating or a heating pad incorporating the laminate. The laminates of this invention may be formed into garments or components of garments, or as heating pads or heating blankets or components of heating pads or heating blankets. The laminates may be in the form of a tape or band that may be integrally formed as a band or cuff or may be sewn into or onto or adhered onto a textile structure as a component thereof.

EXAMPLES

Figure 7:
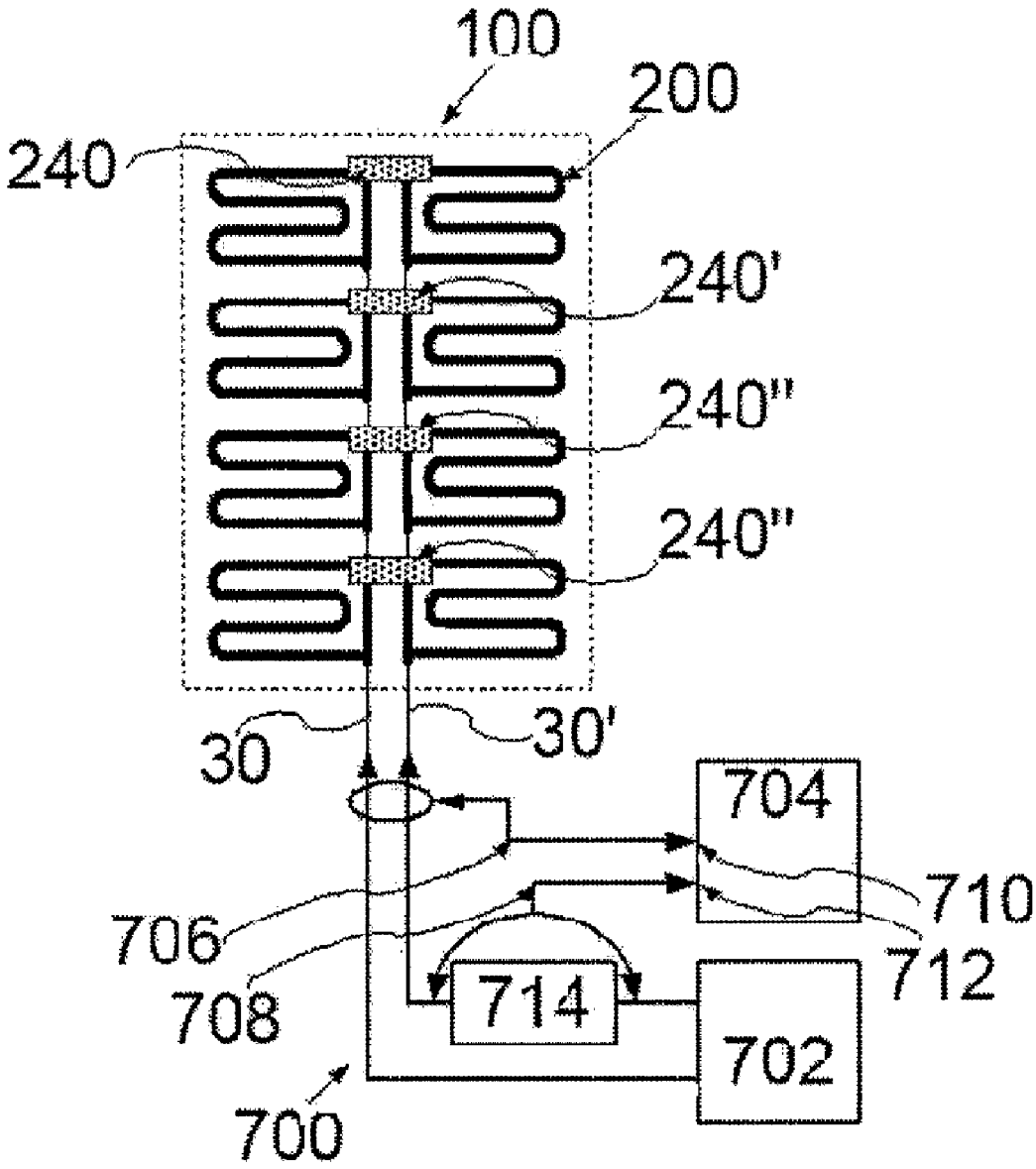
FIG. 7 is a schematic diagram of a test rig to evaluate heating or warming laminates.

A simple test rig 700 for evaluating the resistive heating of various heating and warming laminate structures is shown schematically in FIG. 7. Referring to FIG. 7, a laminate 100 (such as that shown in FIGS. 2*a* and 2*b*) with patterned heating elements 200 and bus wires 30, 30' is one example of a laminate structure to be tested in such rig 700. The laminate structure 100 is pressed to a heat-sinking surface with a flexible pad, such as an insulating foam or quilted pad, and 10 pound weight (not shown). The bus wires 30, 30' are connected in series to a constant voltage power supply 702. A current sense resistor 214 is installed in one of the leads to the constant voltage power supply 702. A data logger 704 receives current sense input 712 via lead 708 from current sense resistor 214 and receives voltage sense input via lead 710 from bus wires 30, 30'.

Once the laminate structure 100 to be tested is held within the test rig 700, the constant voltage power supply 702 is activated to apply about 120% of rated power to the laminate structure. The voltage ("V") is measured across the pad bus wires 30, 30'. The current ("I") is measured in the bus wires 30, 30'. From these measurements, the power ("P") delivered to the laminate 100 is calculated as P=V*I. The temperature of the heating and warming laminate is a function of heat flux from the pad and the total element-to-ambient thermal resistance. The thermal resistance of the heat-sink is sufficient to avoid over-heating of the laminate.

TABLE 1

Experimental Heating and Warming Laminates

| Substrate | Pattern | Ink | Resistance |
|---|---|---|---|
| Cetus ® CP6031 | FIG. 2a | Xink "Packaging Ink" | Xbar = 22.9<br>Sigma = 1.3 |
| Cetus ® CP6031 | FIG. 2a | Xink "Antenna Ink" | Xbar = 17.2<br>Sigma = 0.84 |
| Pebax ® 30 gsm nonwoven | FIG. 2a | Xink "Antenna Ink" | Xbar = 58.2<br>Sigma = 6.9 |

Ink for the Examples of FIG. 2*a* was applied to a coating weight of about 0.33 g per pattern of 5.35 $in^2$ or 0.062 $g/in^2$. When applied at such coating weight, the Packaging Ink had a sheet resistivity of about 0.46 Ohms per square, and the Antenna Ink had a sheet resistivity of about 0.34 Ohms per square. Xink® conductive inks are available from Acheson Electronic Materials.

The Cetus® substrate was a nonwoven polyester coated with urethane that had a thickness of 90±15 μm. This is a printable textile fabric available from Dynic USA Corporation of Hillsboro, Oreg.

The Pebax® resin nonwoven is available from Arkema, Inc. of Philadelphia, Pa.

The bus wires were braided copper—part number NE16240T from Cooner Wire Company.

The laminates were substantially flat and formed without gathers or elastic intended to form puckers. No stretch and recovery element was included in these particular example laminates.

General Calculation for 3.7V and 7.4V Power Supplies

P=Power (W), V=Voltage (V), I=Current (A), R=Resistor (U)

P=V*I=V2/R

TABLE 2

Calculated Resistor & Current Values for 3.7 V Battery-Voltage

| Power (W) | Resistor (Ω) | Current (A) |
|---|---|---|
| 5 | 2.7 | 1.4 |
| 7.5 | 1.8 | 2.0 |
| 10 | 1.4 | 2.7 |
| 15 | 0.9 | 4.1 |
| 20 | 0.7 | 5.3 |

TABLE 3

Calculated Resistor & Current Values for 7.4 V Battery-Voltage

| Power (W) | Resistor (Ω) | Current (A) |
|---|---|---|
| 5 | 11 | 0.7 |
| 7.5 | 7.3 | 1.0 |
| 10 | 5.5 | 1.4 |
| 15 | 3.7 | 2.0 |
| 20 | 2.7 | 2.7 |

Nothing in this specification should be considered as limiting the scope of the present invention. All examples presented are representative and non-limiting. The above described embodiments of the invention may be modified or varied, and elements added or omitted, without departing from the invention, as appreciated by persons skilled in the art in light of the above teachings. It is therefore to be understood that the invention is to be measured by the scope of the claims, and may be practiced in alternative manners to those which have been specifically described in the specification.

The invention claimed is:

1. An electrically conductive laminate for heating or warming, comprising:

first and second substantially electrically insulating material sheets adhered to one another on confronting surfaces, first and second electrical conductor means provided between the confronting surfaces of the sheets, and a plurality of patterns on a portion of the confronting surface of the first sheet, wherein said patterns are arranged serially and coextensively with the electrical conductor means so as to have a plurality of regions of intersection between the patterns and the electrical conductor means, wherein the patterns are selected to provide electrical conductivity, wherein a portion of at least one of said patterns electrically contacts the conductor means at regions of intersection, and wherein at least one region of intersection further comprises a means to selectively interrupt the electrical contact of at least one of the electrical conductor means.

2. The laminate of claim 1 wherein said means to selectively interrupt electrical contact with at least one electrical conductor means comprises at least one void extending along a substantially vertically aligned axis to the plane of the laminate.

3. The laminate of claim 1, wherein said patterns comprise electrically conductive ink applied onto the confronting surface.

4. The laminate of claim 1, wherein said electrical conductor means comprises one or more bus wires.

5. The laminate of claim 1, wherein the substantially electrically insulating materials are selected from the group consisting of nonwoven fabric, woven fabric, knit fabric, paper, and polymer film.

6. The laminate of claim 1, wherein each electrical conductor means includes at least one electrical connector.

7. The laminate of claim 1, wherein the laminate further comprises at least one stretch and recovery element coextending with the electrical conductor means.

8. The laminate of claim 7, wherein the stretch and recovery element comprises spandex.

9. A method for making an electrically conductive laminate comprising:

providing a first sheet of a substantially electrically insulating material, forming image-wise on a surface of the first sheet one or more patterns using an electrically conductive ink or paste, coextending at least one length of electrically conductive wire with the first sheet and aligning at least a portion of the conductive wire to intersect at least a portion of the pattern(s) to form an electrically conductive region of intersection between wire and pattern, providing a second sheet of a substantially electrically insulating material, securing a confronting surface of said second sheet to a confronting surface of said first sheet by providing adhesive means between the confronting surfaces, wherein the pattern(s) and the conductive wire and the sheets form the laminate when the confronting surfaces are secured and the pattern(s) and conductive wire are within said laminate, and forming at least one void through the laminate that extends along a substantially vertically aligned axis to the plane of the laminate.

10. The method for making a laminate of claim 9 comprising forming the void by hole punching.

11. The method for making the laminate of claim 9, further comprising forming the pattern(s) with electrically conductive ink or paste as a repeating pattern with discrete pattern components separated by discontinuities.

12. The method for making a laminate of claim 11, wherein each pattern has a plurality of discrete pattern components.

13. The method for making a laminate of claim 11, further comprising separating at least one discrete pattern component from the remaining pattern components to form first and second laminates from the laminate.

14. A garment or wearable incorporating the laminate of claim 1.

15. A blanket or heating pad incorporating the laminate of claim 1.

* * * * *